US011084303B2

(12) United States Patent
Iijima et al.

(10) Patent No.: US 11,084,303 B2
(45) Date of Patent: Aug. 10, 2021

(54) PRINTING DEVICE CONFIGURED TO ACCOMMODATE CASSETTE WITH PORTION OF THE CASSETTE PROTRUDING OUT OF HOUSING

(71) Applicant: BROTHER KOGYO KABUSHIKI KAISHA, Nagoya (JP)

(72) Inventors: Shota Iijima, Nagoya (JP); Takanori Izumi, Nagoya (JP)

(73) Assignee: BROTHER KOGYO KABUSHIKI KAISHA, Nagoya (JP)

( * ) Notice: Subject to any disclaimer, the term of this patent is extended or adjusted under 35 U.S.C. 154(b) by 0 days.

(21) Appl. No.: 16/734,321

(22) Filed: Jan. 4, 2020

(65) Prior Publication Data

US 2020/0269621 A1 Aug. 27, 2020

(30) Foreign Application Priority Data

Feb. 26, 2019 (JP) ..... JP2019-032857

(51) Int. Cl.
*B41J 32/00* (2006.01)
*B41J 3/407* (2006.01)
*B41J 11/70* (2006.01)

(52) U.S. Cl.
CPC ..... *B41J 32/00* (2013.01); *B41J 3/4075* (2013.01); *B41J 11/70* (2013.01); *B41J 11/703* (2013.01)

(58) Field of Classification Search
CPC ..... B41J 32/00; B41J 11/703; B41J 3/4075; B41J 11/70
See application file for complete search history.

(56) References Cited

U.S. PATENT DOCUMENTS 7,988,373 B2 * 8/2011 Vandermeulen ..... B41J 3/4075 400/613
2004/0161278 A1 8/2004 Harada
2020/0207115 A1 7/2020 Ishimoto et al.

FOREIGN PATENT DOCUMENTS

WO 2014/063161 A2 4/2014

* cited by examiner

*Primary Examiner* — Geoffrey S Mruk
(74) *Attorney, Agent, or Firm* — Kenealy Vaidya LLP

(57) ABSTRACT

A printing device includes: a housing; a cassette receiving portion provided in the housing; and a print head provided at the cassette receiving portion. The cassette receiving portion is configured to detachably receive a cassette including a case in which an ink ribbon and a tape are provided. The print head extends in a first direction and is configured to be inserted in a head opening of the case upon attachment of the cassette to the cassette receiving portion. The print head is configured to perform printing to the tape via the ink ribbon. The cassette receiving portion is open in the first direction and in a second direction orthogonal to the first direction. Upon attachment of the cassette to the cassette receiving portion, a portion of the cassette protrudes out of the housing in the second direction.

19 Claims, 8 Drawing Sheets

PRINTING DEVICE CONFIGURED TO ACCOMMODATE CASSETTE WITH PORTION OF THE CASSETTE PROTRUDING OUT OF HOUSING

CROSS REFERENCE TO RELATED APPLICATION

This application claims priority from Japanese Patent Application No. 2019-032857 filed Feb. 26, 2019. The entire content of the priority application is incorporated herein by reference.

TECHNICAL FIELD

The present disclosure relates to a printing device.

BACKGROUND

International Application Publication No. WO2014/063161 discloses a printing device including a housing within which a print head is disposed. A cassette attachment portion is provided at one end of the housing, and a tape discharge slot is provided at another end of the housing. The cassette attachment portion is configured to accommodate a cassette incorporating a tape in a state where a portion of the cassette protrudes out from the housing. The tape paid out from the cassette is subjected to printing by the print head, and then discharged through the tape discharge slot.

SUMMARY

Conceivably, the cassette may further include an ink ribbon, so that the print head may perform printing to the tape using the ink ribbon. However, in the above-described conventional printing device, the cassette is configured to be attached to the cassette attachment portion in a direction along which the tape is conveyed. Hence, a user may have difficulty in arranging the ink ribbon inside the cassette to face the print head.

In view of the foregoing, it is an object of the disclosure to provide a printing device capable of receiving a cassette incorporating an ink ribbon with a portion of the cassette protruding out from a housing, while facilitating attachment of the cassette.

In order to attain the above and other objects, the disclosure provides a printing device including a housing, a cassette receiving portion, and a print head. The cassette receiving portion is provided in the housing and is configured to detachably receive a cassette including a case in which an ink ribbon and a tape are provided, the case being formed with a head opening. The print head is provided at the cassette receiving portion and is configured to perform printing to the tape via the ink ribbon. The print head extends in a first direction and is configured to be inserted in the head opening upon attachment of the cassette to the cassette receiving portion. The cassette receiving portion is open in the first direction and in a second direction orthogonal to the first direction. Upon attachment of the cassette to the cassette receiving portion, a portion of the cassette protrudes out of the housing in the second direction.

BRIEF DESCRIPTION OF THE DRAWINGS

The particular features and advantages of the disclosure as well as other objects will become apparent from the following description taken in connection with the accompanying drawings, in which.

DETAILED DESCRIPTION

Hereinafter, a printing device 1 according to one embodiment will be described with reference to FIGS. 1 through 8.

Figure 2:
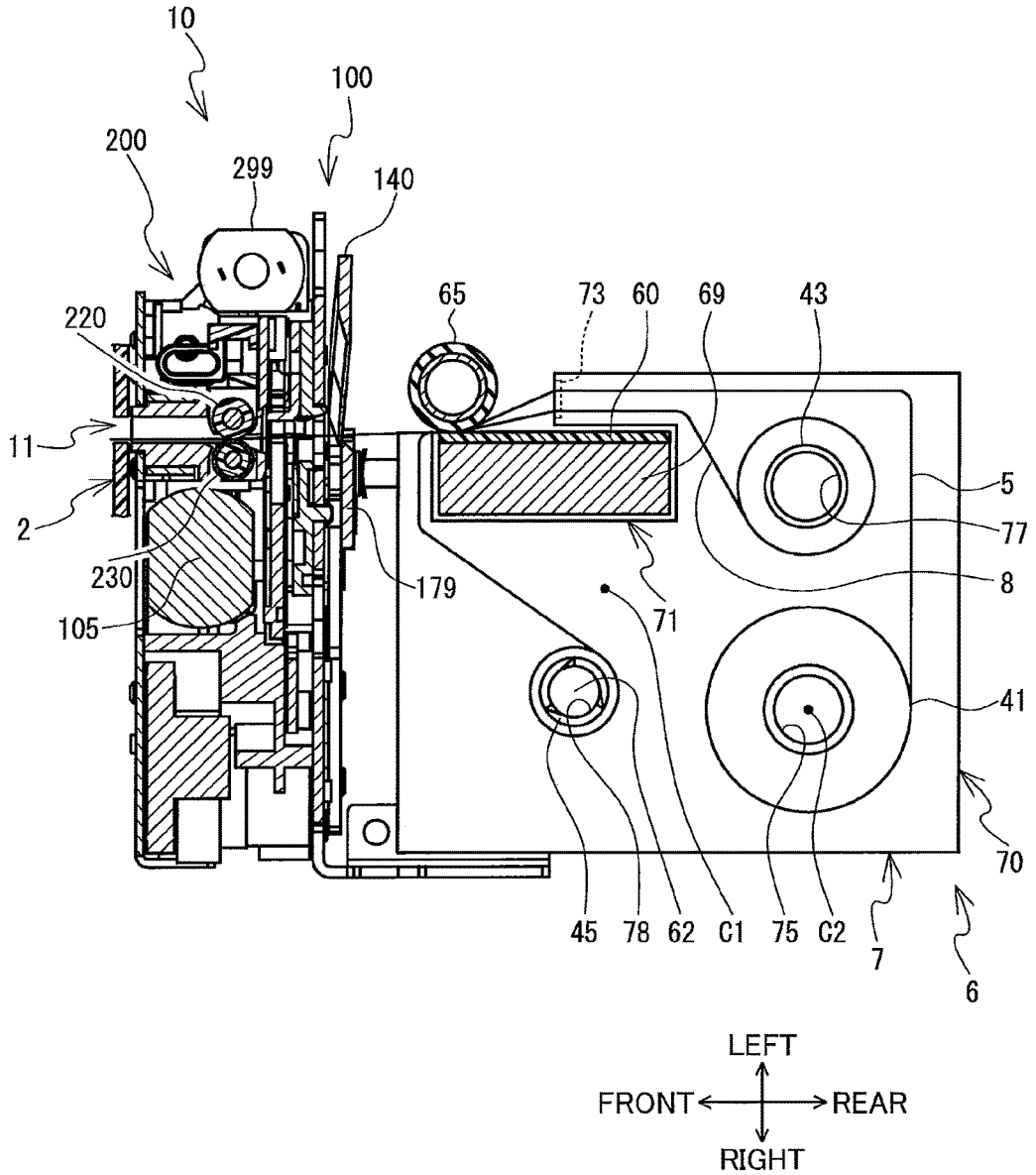
FIG. 2 is a cross-sectional view of the printing device according to the embodiment in a state where a first cassette is attached.
Figure 3:
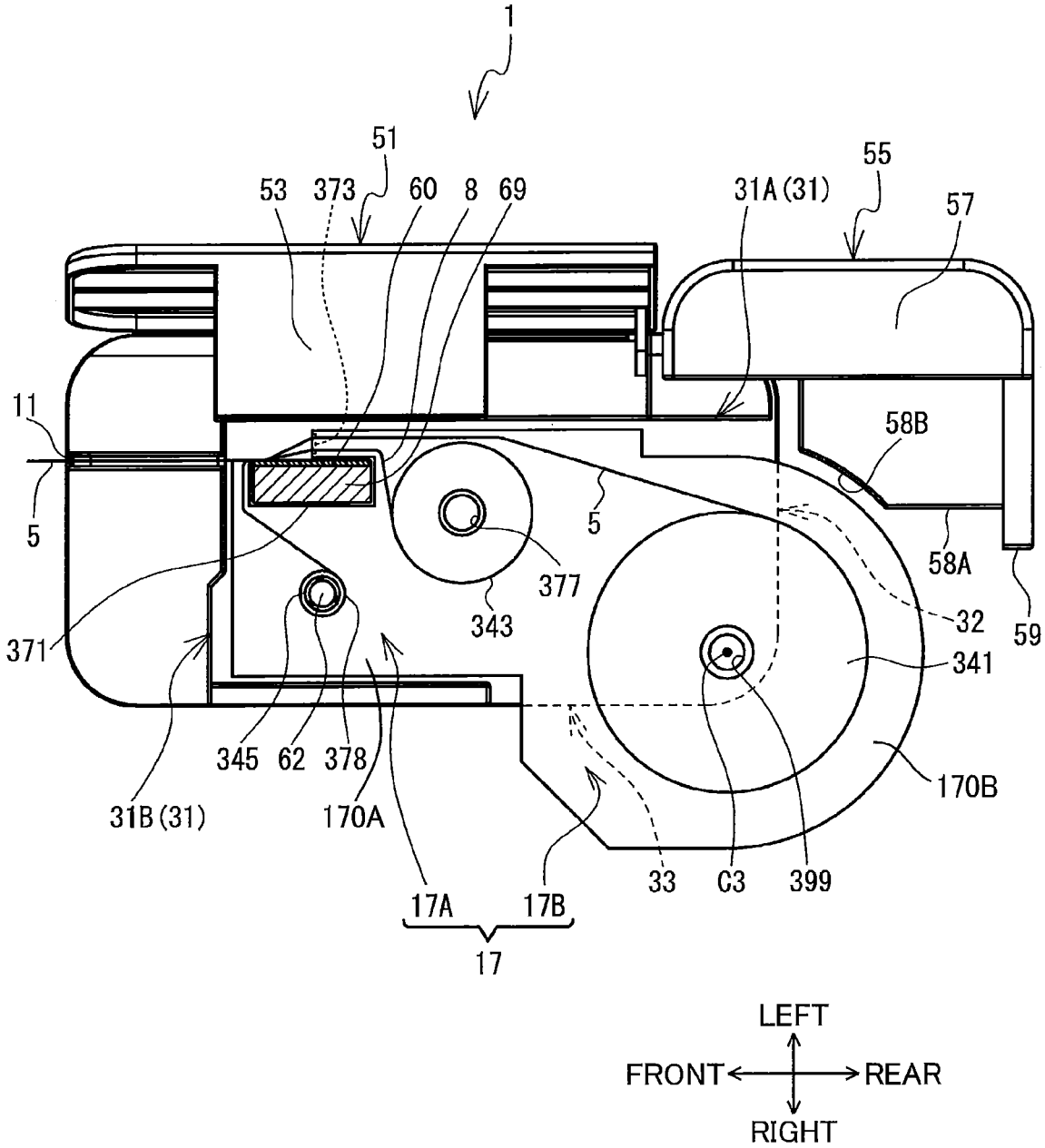
FIG. 3 is a partial cross-sectional plan view of the printing device according to the embodiment in a state where a second cassette is attached.
Figure 4:
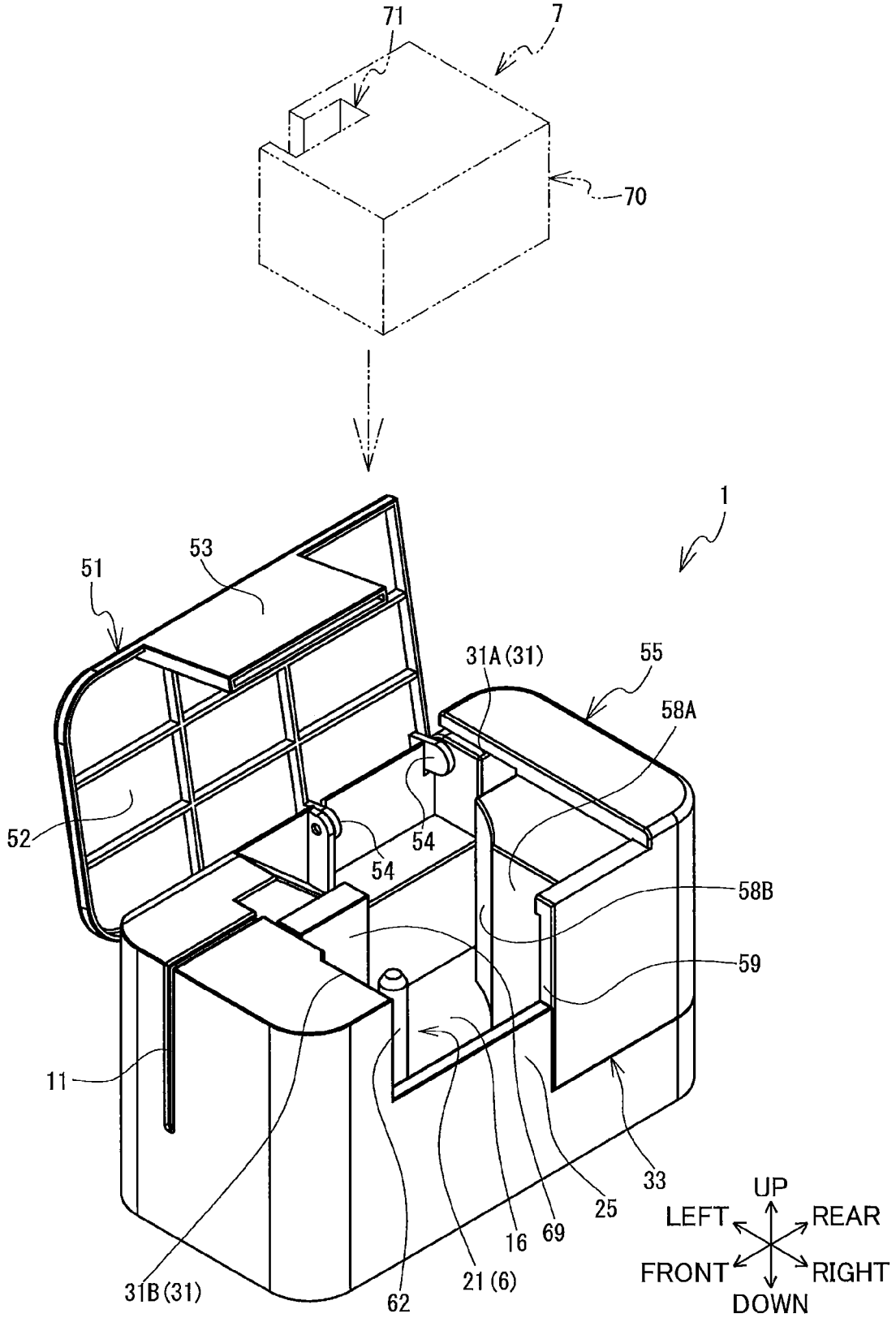
FIG. 4 is a perspective view of the printing device according to the embodiment prior to attachment of the first cassette.
Figure 5:
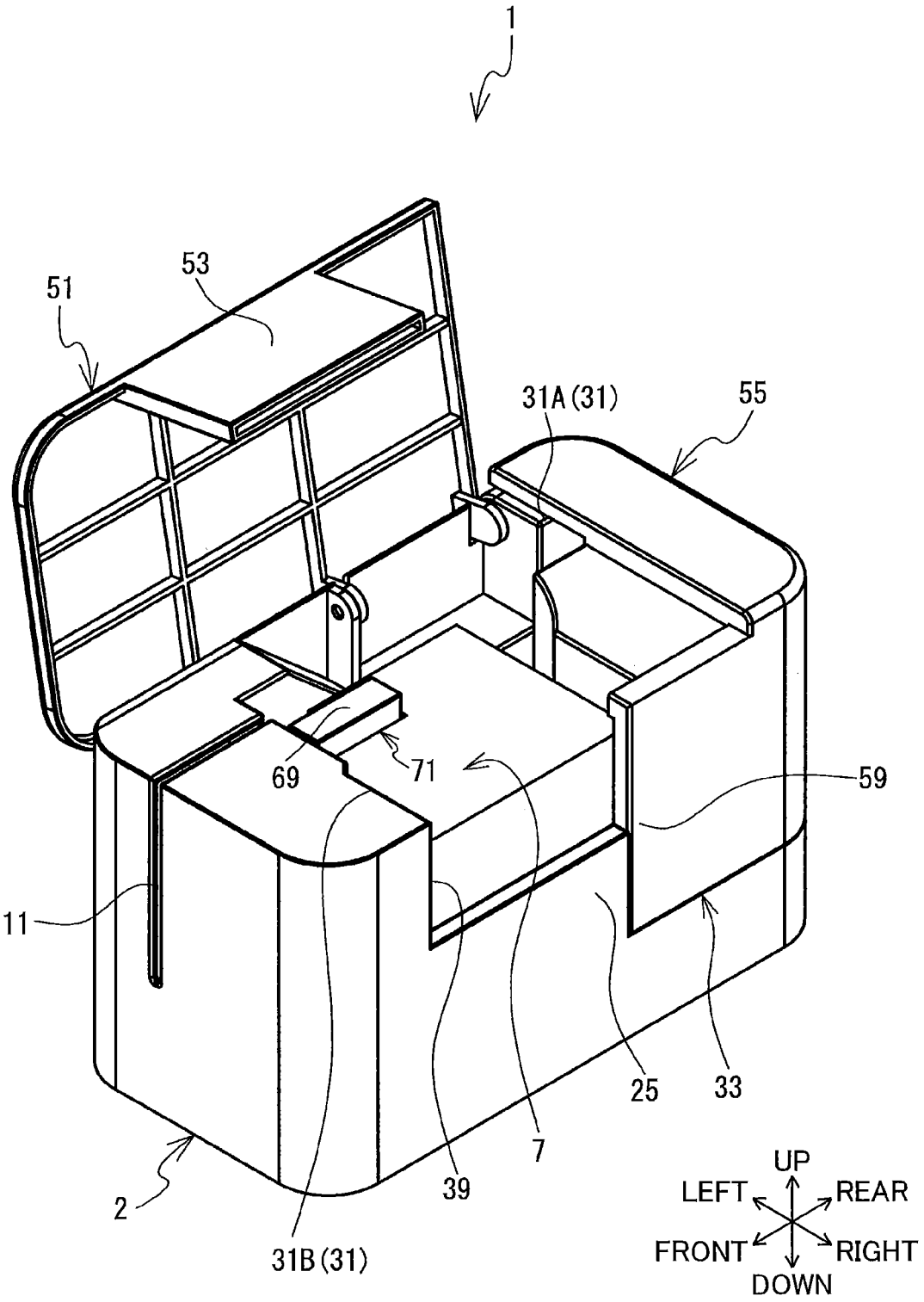
FIG. 5 is a perspective view of the printing device according to the embodiment after attachment of the first cassette.
Figure 7:
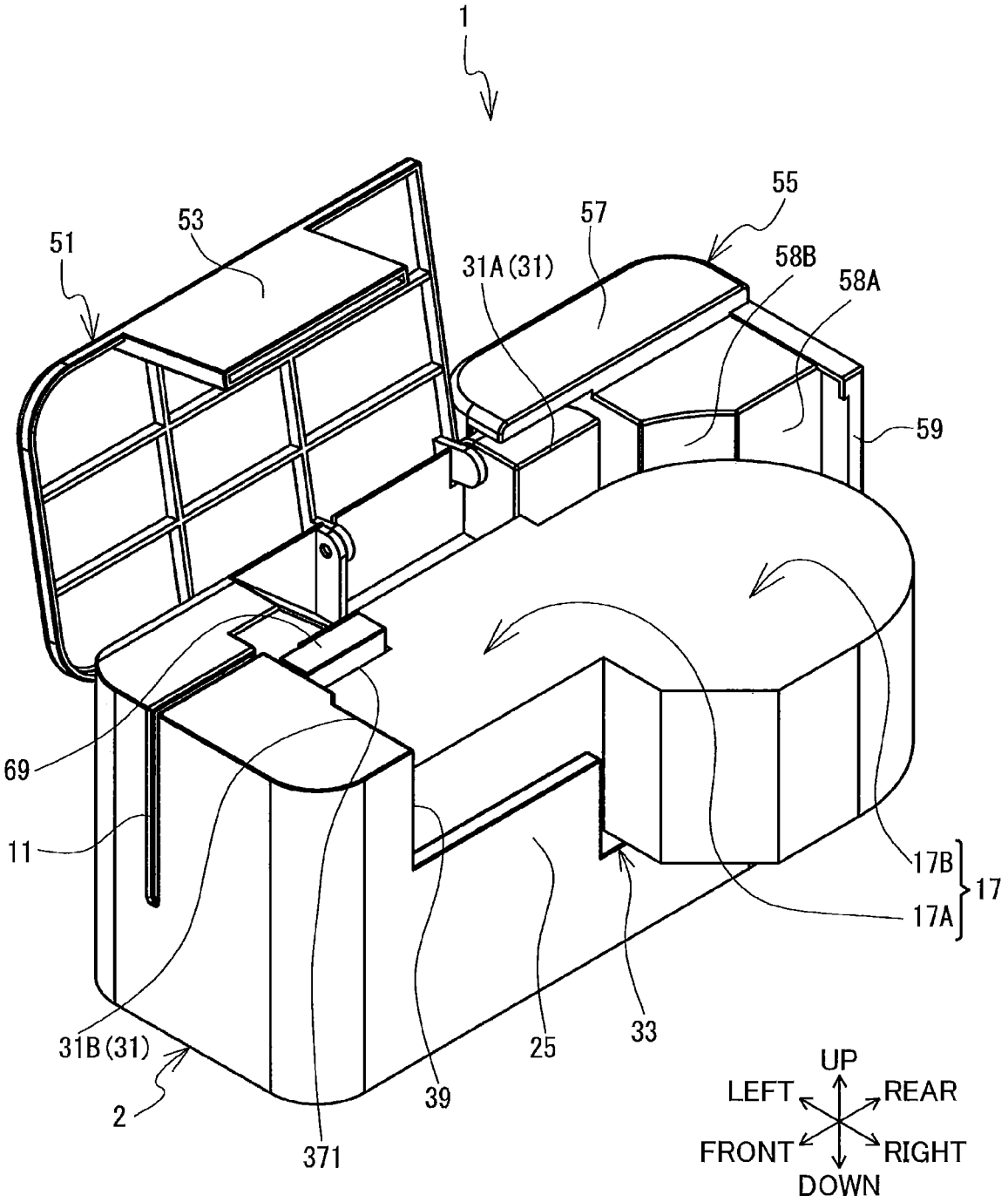
FIG. 7 is a perspective view of the printing device according to the embodiment after attachment of the second cassette in a state where the housing cover is opened.
Figure 8:
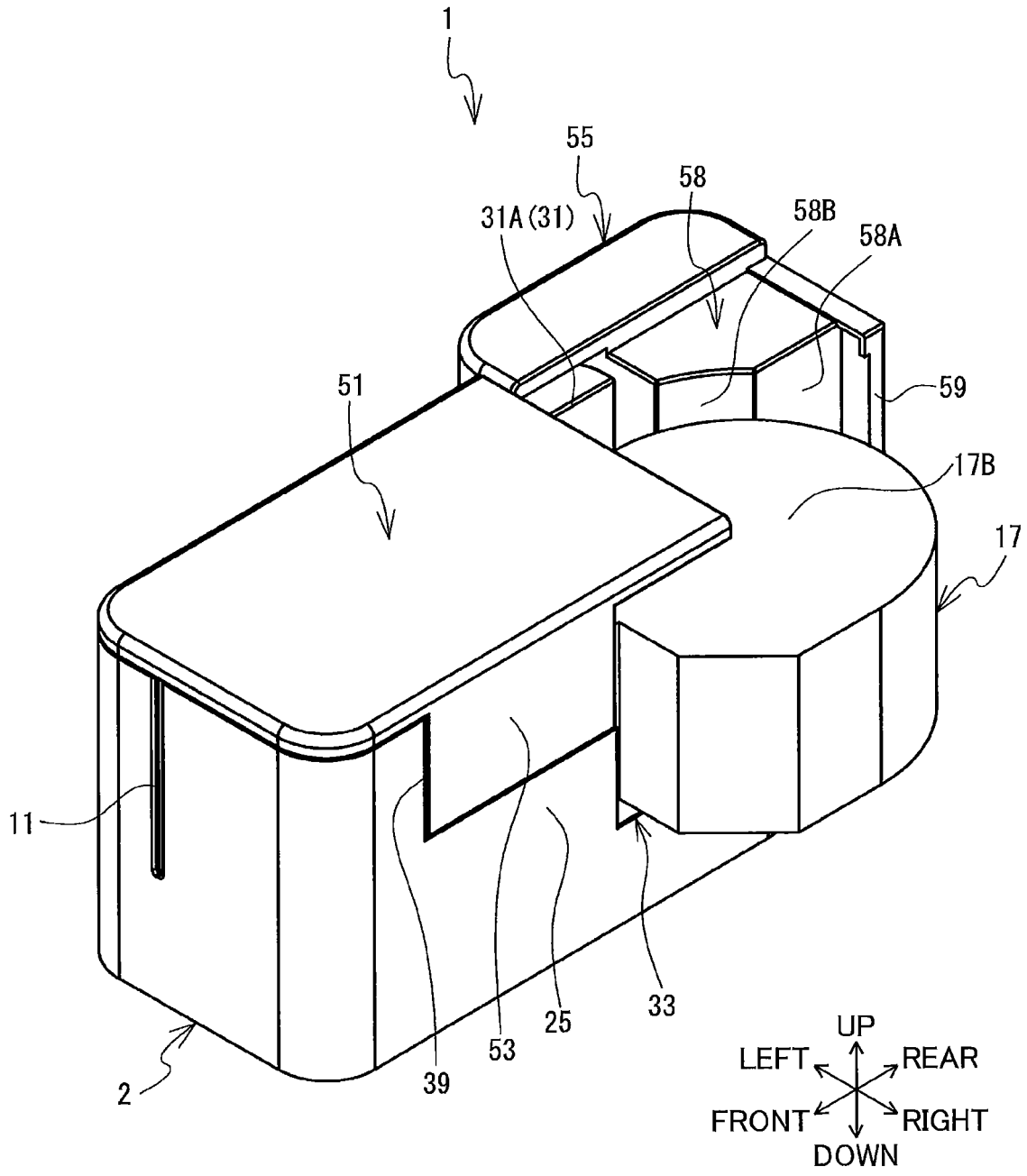
FIG. 8 is another perspective view of the printing device according to the embodiment after attachment of the second cassette in a state where the housing cover is opened.

The printing device 1 is configured to selectively receive one of a first cassette 7 and a second cassette 17 having sizes different from each other. The second cassette 17 is larger in size than the first cassette 7. Incidentally, the first cassette 7 is schematically illustrated in FIGS. 2, 4, and 5, whereas the second cassette 17 is schematically illustrated in FIGS. 3, 7, and 8.

In the following description, directions with regard to the printing device 1 will be described based on a posture of the printing device 1 illustrated in FIG. 1. Specifically, a diagonally upper leftward direction, a diagonally lower rightward direction, a diagonally lower leftward direction, a diagonally upper rightward direction, an upward direction, and a downward direction in FIG. 1 will be referred to as a leftward direction, a rightward direction, a frontward direction, a rearward direction, an upward direction, and a downward direction of the printing device 1, respectively.

First, an outline of the printing device 1 will be described with reference to FIGS. 1 and 2.

The printing device 1 includes a housing 2 having a generally rectangular parallelepiped shape. The housing 2 includes a bottom part 2A in which an electrical circuit board (not illustrated) extending in a leftward/rightward direction and a frontward/rearward direction is accommodated. The electrical circuit board is provided with a CPU and a USB connecting portion, and the like. The CPU is configured to control overall operations performed in the printing device 1.

Figure 1:
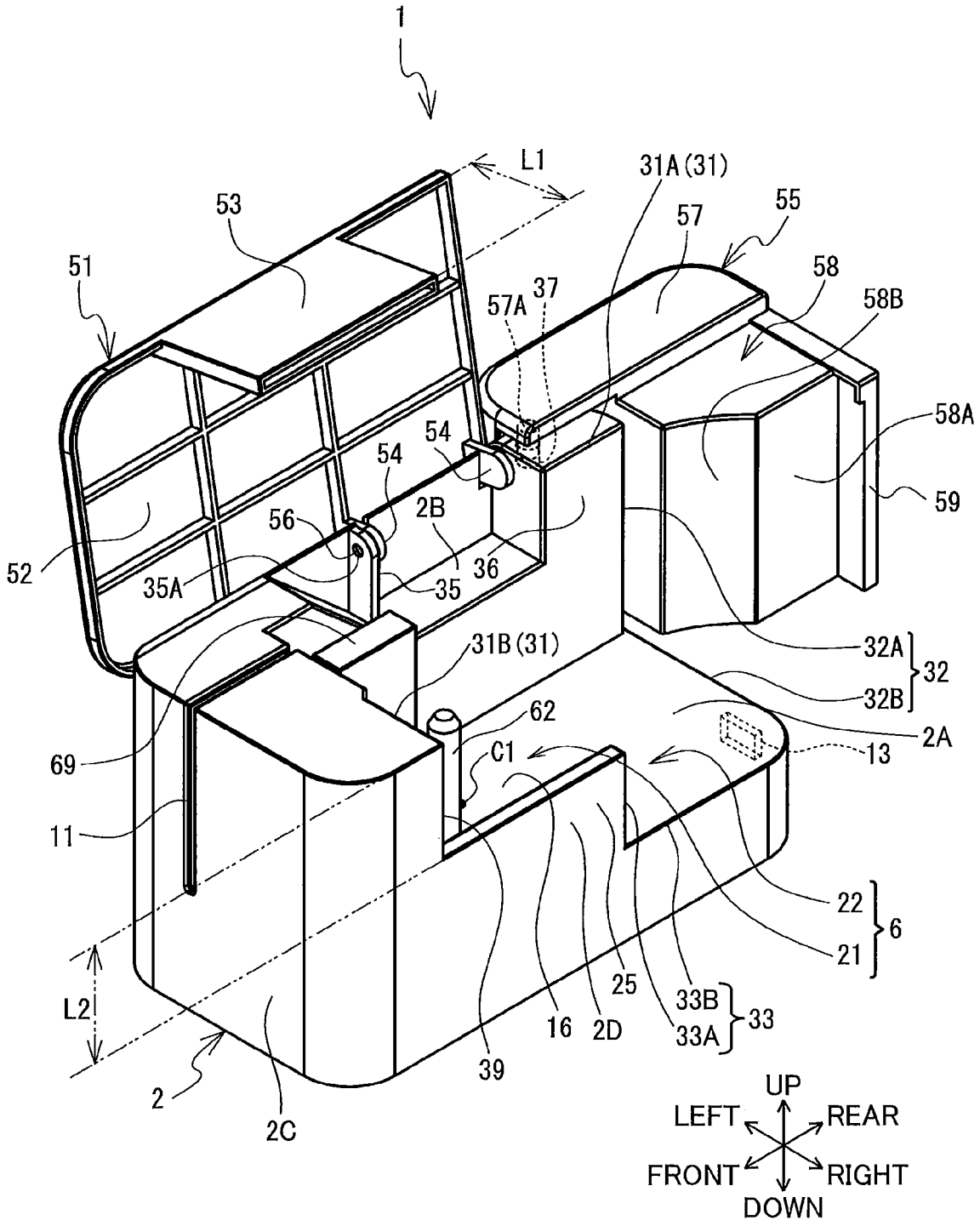
FIG. 1 is a perspective view of a printing device according to one embodiment.

The bottom part 2A has a rear end portion formed with an insertion hole 13 that is open rearward (see FIG. 1). The housing 2 defines a center C1 in the leftward/rightward direction and the frontward/rearward direction. The insertion hole 13 is positioned offset rightward relative to the center C1 in the leftward/rightward direction. The USB connecting portion is positioned inside the insertion hole 13. An USB cable (not illustrated) as an example of an electric wiring is connectable to the USB connecting portion through the insertion hole 13. One end portion of the USB cable is inserted into the insertion hole 13 to be connected to the USB connecting portion, and another end portion of the USB cable is connectable to a personal computer (not illustrated). The printing device 1 is configured to print character(s) on a tape 5 according to print data transmitted through the USB cable. The characters may be letters, numerals, symbols, and diagrams.

The housing 2 includes a left side part 2B connected to the bottom part 2A and extending in the frontward/rearward direction and an upward/downward direction. In the left side part 2B, an input portion (not illustrated) is provided. The input portion is in a form of buttons for inputting various information into the printing device 1.

The housing 2 also includes a front side part 2C connected to the bottom part 2A and the left side part 2B and extending in the leftward/rightward direction and upward/downward direction. A discharge opening 11 is formed in the front part 2C. The discharge opening 11 extends in the frontward/rearward direction and is open frontward and rearward. The discharge opening 11 is positioned offset leftward relative to the center C1 in the leftward/rightward direction. The discharge opening 11 provides communication between an inside and an outside of the housing 2 in the printing device 1.

The housing 2 further includes a right side part 2D connected to the bottom part 2A and the front part 2C and extending in the frontward/rearward direction and upward/downward direction. A cassette receiving portion 6 is provided as a space defined by the bottom part 2A, the left side part 2B, the front side part 2C, and the right side part 2D. In other words, the cassette receiving portion 6 is a recessed portion recessed downward from a top surface of the housing 2.

Selected one of the first cassette 7 and the second cassette 17 is attachable to the cassette receiving portion 6. A front end of the first cassette 7 attached to the cassette receiving portion 6 is at the same position as a front end of the second cassette 17 attached to the cassette receiving portion 6 (see FIGS. 5 and 7). Further, a left end of the first cassette 7 attached to the cassette receiving portion 6 is at the same position as a left end of the second cassette 17 attached to the cassette receiving portion 6 (see FIGS. 5 and 7).

The bottom part 2A has an upper surface 16, which is a lower end of the cassette receiving portion 6. The upper surface 16 extends in the leftward/rightward direction and frontward/rearward direction. The upper surface 16 functions as a surface adapted to oppose and contact one of the first cassette 7 and the second cassette 17 attached to the cassette receiving portion 6 from below thereof. The upper surface 16 will be referred to as an opposing surface 16, hereinafter.

The cassette receiving portion 6 provides a first cassette receiving portion 21, and a second cassette receiving portion 22. The first cassette receiving portion 21 is adapted to receive the first cassette 7 therein. The first cassette receiving portion 21 constitutes a front portion of the cassette receiving portion 6. Hence, a front portion of the opposing surface 16 constitutes a lower end of the first cassette receiving portion 21.

The second cassette receiving portion 22 is adapted to receive the second cassette 17 therein. In the present embodiment, the second cassette receiving portion 22 in its entirety is coincident with the cassette receiving portion 6. Hence, an entirety of the opposing surface 16 constitutes a lower end of the second cassette receiving portion 22. The second cassette receiving portion 22 contains the first cassette receiving portion 21.

The cassette receiving portion 6 has a first open end 31, a second open end 32, and a third open end 33.

The first open end 31 is open upward and constitutes an open upper end of the cassette receiving portion 6. The first open end 31 also constitutes an open upper end of the first cassette receiving portion 21, as well as an open upper end of the second cassette receiving portion 22.

Referring to FIG. 1, the first open end 31 is defined by: a first outline part 31A extending in the frontward/rearward direction; and a second outline part 31B extending in the leftward/rightward direction. More specifically, the left side part 2B includes a rear wall portion 36 having a top horizontal surface and an inner vertical surface facing rightward. The first outline part 31A is an intersection between the top horizontal surface and the inner vertical surface of the rear wall portion 36. The front side part 2C includes a protruding wall portion 39 having a top horizontal surface and a rear vertical surface. The second outline part 31B is an intersection between the top horizontal surface and the rear vertical surface.

The second open end 32 is open rearward and constitutes a rear open end of the cassette receiving portion 6. The second open end 32 also constitutes an open rear portion of the second cassette receiving portion 22.

Specifically, the second open end 32 is defined by: a first outline part 32A extending in the upward/downward direction; and a second outline part 32B extending in the leftward/rightward direction. The first outline part 32A is an intersection between the inner vertical surface of the rear wall portion 36 a rear surface of the rear wall portion 36. The second outline part 32B is an intersection between an upper surface of the bottom part 2A (opposing surface 16) and a rear surface of the bottom part 2A. The second outline part 32B extends rightward from a bottom end of the first outline part 32A.

The third open end 33 is open rightward and constitutes a right open end of the cassette receiving portion 6. The third open end 33 also constitutes a part of the second cassette receiving portion 22.

Specifically, the right side part 2D includes a wall portion 25 having a rectangular plate shape in a right side view. The wall portion 25 extends upward from the bottom part 2A and defines a right end of the first cassette receiving portion 21. The wall portion 25 has a front end connected to the protruding wall portion 39. The protruding wall portion 39 protrudes further upward than the wall portion 25. The third open end 33 is positioned rearward of the wall portion 25.

The third open end 33 is defined by: a first outline part 33A extending vertically; and a second outline part 33B extending in the frontward/rearward direction. The first outline part 33A is an intersection between a right end surface and a rear end surface of the wall portion 25. The second outline part 33B is an intersection between the upper surface (opposing surface 16) and a right surface of the bottom part 2A. A vertical position of the second outline part 33B of the third open end 33 is the same as that of the second outline part 32B of the second open end 32.

As illustrated in FIG. 1, the left side part 2B also includes a front wall portion 35 opposing the rear wall portion 36 in the frontward/rearward direction. The front wall portion 35 extends vertically, and is spaced away from the rear wall portion 36. The front wall portion 35 has an upper end portion formed with a cylindrical hole 35A extending therethrough in the frontward/rearward direction. The cylindrical hole 35A has a circular shape in a front view.

The rear wall portion 36 has an upper end portion formed with a cylindrical engagement hole (not illustrated) and a support hole 37. The engagement hole extends in the frontward/rearward direction and is open frontward. The engagement hole is circular in a front view and is coaxial with the cylindrical hole 35A. the support hole 37 is positioned rearward of the engagement hole and is open upward on the top surface of the rear wall portion 36. The support hole 37 has a circular cross-section.

The printing device 1 further includes a housing cover 51 configured to open and close the first open end 31. The housing cover 51 includes a base portion 52, a pair of protruding portions 54, a pair of engagement portions 56, and a protruding cover 53.

The base portion 52 is plate shaped. The pair of protruding portions 54 is provided at one end portion (a left end portion) of the base portion 52 with respect to the leftward/rightward direction. The protruding portions 54 are arranged to be spaced apart from each other in the frontward/rearward direction. The protruding portions 54 protrude from the left end portion of the base portion 52 in a thickness direction of the base portion 52.

Each of the pair of engagement portions 56 protrudes from each tip end portion of corresponding one of the pair of protruding portions 54 in the frontward/rearward direction. Specifically, a front one of the engagement portions 56 protrudes frontward from a tip end portion of a front one of the protruding portions 54, and a rear engagement portion 56 (not illustrated) protrudes rearward from a rear one of the protruding portions 54. The front one of the engagement portions 56 is rotatably fitted with the cylindrical hole 35A of the front wall portion 35, and the rear one of the engagement portions 56 (not illustrated) is rotatably fitted with the engagement hole (not illustrated) of the rear wall portion 36. Hence, the housing cover 51 is pivotably supported by the left side part 2B.

Figure 6:
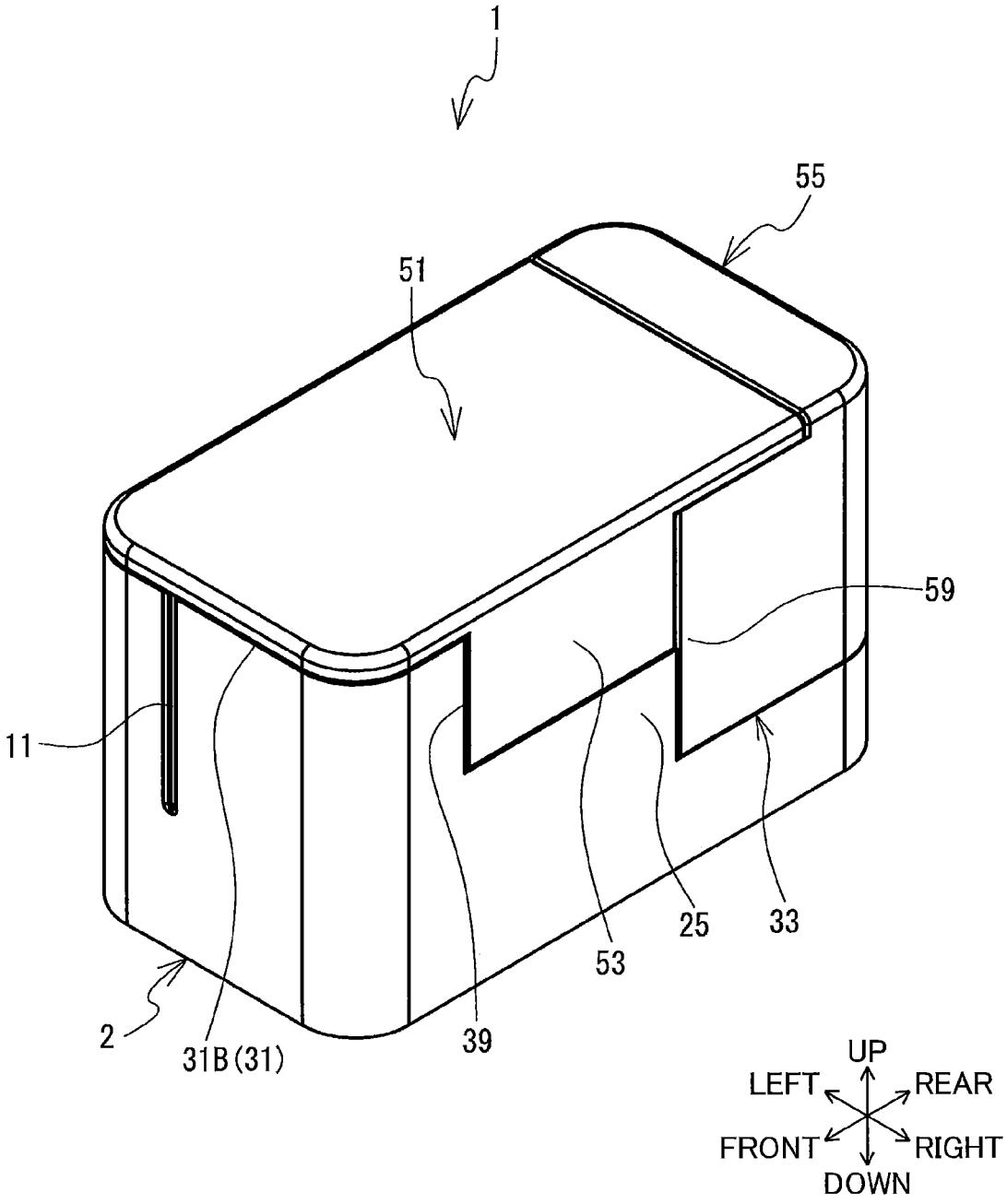
FIG. 6 is a perspective view of the printing device according to the embodiment in a state where a housing cover and a movable cover are closed.

The housing cover 51 is pivotally movable between an open position (FIG. 1) and a closed position (FIG. 6). At the open position, the housing cover 51 exposes the first open end 31 upward. At the closed position, the housing cover 51 closes the first open end 31 from above. At the closed position of the housing cover 51, a front end portion of the base portion 52 faces the protruding wall portion 39, and the left end portion of the base portion 52 faces the left side part 2B. A pivotally moving direction of the housing cover 51 from the open position to the closed position will be referred to as a "closing direction" as appropriate, hereinafter.

The protruding cover 53 is provided at another end portion (a right end portion) of the base portion 52. The protruding cover 53 protrudes from the other end portion in the closing direction. In the closed position of the housing cover 51, a tip end face of the protruding cover 53 faces a top surface of the wall portion 25. The protruding cover 53 has a first protruding length L1 that is equal to or greater than a second protruding length L2 by which the protruding wall portion 39 protrudes upward from the wall portion 25 in a direction opposite to the closing direction.

The printing device 1 further includes a movable cover 55. The movable cover 55 is configured to open and close the second open end 32 and the third open end 33. The movable cover 55 includes a base portion 57, and a protruding wall portion 58. The base portion 57 is plate shaped, and has a generally rectangular shape in a plan view. The base portion 57 has one end portion positioned above the rear wall portion 36. A shaft portion 57A is provided at the one end portion of the base portion 57 to protrude downward therefrom. The shaft portion 57A is rotatably fitted with the support hole 37 of the rear wall portion 36. Hence, the movable cover 55 is pivotally movably supported by the rear wall portion 36 of the left side part 2B about an axis of the shaft portion 57A. The movable cover 55 is pivotally movable in a first rotational direction toward the rear surface of the wall portion 25, and in a second rotational direction (opposite the first rotational direction) away from the rear surface of the wall portion 25.

The base portion 57 has another end portion to which the protruding wall portion 58 is connected. The protruding wall portion 58 is so positioned and shaped to avoid interference with the rear wall portion 36. The protruding wall portion 58 protrudes from the base portion 57 in a clockwise direction (the first rotational direction) about the axis of the shaft portion 57A in a plan view.

The protruding wall portion 58 includes an abutment portion 59, a guide portion 58A, and a curved portion 58B. The abutment portion 59 is a radially outermost end portion of the protruding wall portion 58 about the axis of the shaft portion 57A. In other words, the abutment portion 59 is a downstream end of the protruding wall portion 58 in the first rotational direction. That is, the abutment portion 59 constitutes a free end portion of the protruding wall portion 58 in the clockwise direction about the axis of the shaft portion 57A in a plan view.

The guide portion 58A and the curved portion 58B are positioned between the shaft portion 57A and the abutment portion 59. The guide portion 58A extends vertically and perpendicular to the first rotational direction. That is, the guide portion 58A faces downstream in the first rotational direction. As described later, the guide portion 58A is configured to guide attachment of the first cassette 7 to the first cassette receiving portion 21.

The curved portion 58B is curved in an arcuate shape such that the curved portion 58B is recessed toward the other end portion of the base portion 57. The guide portion 58A and the curved portion 58B are positioned further in the second rotational direction (upstream in the first rotational direction) relative to the abutment portion 59.

The movable cover 55 is pivotally movable about the support hole 37 (i.e., the axis of the shaft portion 57A) between an open position (FIG. 1) and a closed position (FIG. 4). The second open end 32 and the third open end 33 are open (exposed) at the open position. At the open position of the movable cover 55, the base portion 57 extends generally in the frontward/rearward direction. The second open end 32 and the third open end 33 are closed by the movable cover 55 at the closed position. At the closed position, the base portion 57 extends generally in the leftward/rightward direction; the protruding wall portion 58 is positioned above the second outline part 32B of the second open end 32 and the second outline part 33B of the third open end 33; and the free end face of the abutment portion 59 is in contact with the rear surface of the wall portion 25. In other words, at least a part of the movable cover 55 is overlapped with the second cassette receiving portion 22 in the upward/downward direction when the movable cover 55 is at the closed position.

The guide portion 58A and the curved portion 58B are positioned further in the second rotational direction relative to the free end face of the abutment portion 59 (downstream end of the abutment portion 59 in the first rotational direction). Therefore, the guide portion 58A and the curved portion 58B are less likely to make contact with the first cassette 7 when the movable cover 55 is at the closed position.

As illustrated in FIGS. 1 and 2, a head holder 69, a print head 60, and a ribbon take-up shaft 62 are provided in the cassette receiving portion 6. The head holder 69 and the print head 60 are positioned leftward of the center C1 of the housing 2. The ribbon take-up shaft 62 is positioned rightward of the center C1 of the housing 2. Further, the insertion hole 13 is positioned offset toward the right from the print head 60.

The head holder 69 extends upward from a left front portion of the opposing surface 16 of the cassette receiving portion 6. The print head 60 is positioned on a left surface of the head holder 69. The print head 60 is a thermal head including a plurality of heat generating elements arrayed in line in the upward/downward direction. Alternatively, a plurality of the heat generating elements may be arrayed in line in the frontward/rearward direction. The ribbon take-up shaft 62 is positioned rightward of the head holder 69 and extends in the upward/downward direction. The ribbon take-up shaft 62 is rotatable about an axis thereof. A platen roller 65 is positioned leftward of the print head 60 to face the same in the leftward/rightward direction. The ribbon take-up shaft 62 and the platen roller 65 are drivingly connected to a conveyer roller (not illustrated) through a plurality of gears (not illustrated).

An internal unit 10 is provided in an interior of the front part 2C of the housing 2 at a position adjacent to the discharge opening 11. The internal unit 10 includes a cutter unit 100 and a discharge unit 200. The cutter unit 100 is configured to perform a cutting operation to the tape 5. The cutting operation includes a full-cutting operation for completely cutting the tape 5 into two separate parts. Specifically, according to the full-cutting, the tape 5 is cut over an entire width and an entire thickness of the tape 5 (i.e., the tape 5 is cut off in a widthwise direction and a thickness direction thereof).

The cutter unit 100 includes a fixed blade 179, a movable blade (full-cutting blade) 140, and a cutter motor 105. The fixed blade 179 and the movable blade 140 are arranged to oppose each other in the leftward/rightward direction. The movable blade 140 is movable in the leftward/rightward direction between a remote position (FIG. 2) and a full-cutting position (not illustrated) by a driving force from the cutter motor 105. At the remote position, the movable blade 140 is positioned away from or leftward of the fixed blade 179. At the full-cutting position, the movable blade 140 is positioned such that the tape 5 is nipped between the movable blade 140 and the fixed blade 179 to perform the full-cutting operation to the tape 5.

The discharge unit 200 is configured to hold the tape 5 cut by the cutter unit 100, and to discharge the tape cut by the cutter unit 100 frontward through the discharge opening 11. The discharge unit 200 includes a discharge roller 220, an opposing roller 230, and a discharge motor 299. The opposing roller 230 and the discharge roller 220 are arranged to oppose each other in the leftward/rightward direction. The discharge roller 220 is configured to nip the tape 5 in cooperation with the opposing roller 230, and to eject the tape 5 frontward by a driving force from the discharge motor 299. At this time, the opposing roller 230 is rotated by rotation of the discharge roller 220. The discharge unit 200 thus ejects the tape 5 frontward through the discharge opening 11.

Next, the first cassette 7 will be described with reference to FIG. 2. In the following description, a structure of the first cassette 7 will be described based on an assumption that the first cassette 7 is attached to the first cassette receiving portion 21. The first cassette 7 includes a case 70 of a box shape. The case 70 is formed with support holes 75, 77, 78, a tape discharge opening 73, and a head opening 71.

The support hole 75, the support hole 77, and the support hole 78 extend throughout a thickness of the case 70 in the upward/downward direction. The tape discharge opening 73 is positioned at a front end of a left end portion of the case 70, and is open frontward. The head opening 71 is in a form of a notch and is positioned at a front half portion of the left end portion of the case 70, as illustrated in FIG. 4. The head opening 71 extends through the thickness of the case 70 in the upward/downward direction.

A first tape spool 41, a ribbon spool 43, and a ribbon take-up spool 45 are provided inside the case 70 of the first cassette 7. The first tape spool 41 extends in the upward/downward direction, and the tape 5 is wound over the first tape spool 41. The first tape spool 41 is rotatably supported by the support hole 75. The tape 5 paid out from the first tape spool 41 is drawn out through the tape discharge opening 73. The tape 5 drawn out through the tape discharge opening 73 moves through a portion between the platen roller 65 and the print head 60, and is discharged toward the internal unit 10. Incidentally, the first tape spool 41 defines a central axis C2 that is positioned rightward of the print head 60. In other words, the print head 60 is positioned offset from the central axis C2 toward the left.

The ribbon spool 43 extends in the upward/downward direction, and an ink ribbon 8 for use in printing is wound over the ribbon spool 43. The ribbon spool 43 is rotatably supported by the support hole 77. The ribbon take-up spool 45 is a hollow cylindrical member extending in the upward/downward direction. The ribbon take-up spool 45 is rotatably supported by the support hole 78. The ribbon take-up shaft 62 of the first cassette receiving portion 21 (cassette receiving portion 6) is inserted in the ribbon take-up spool 45. The ink ribbon 8 used for printing is wound over the ribbon take-up spool 45. The ink ribbon 8 paid out from the ribbon spool 43 is drawn out through the tape discharge opening 73, moves through the portion between the platen roller 65 and the print head 60 along with the tape 5, and is entered into the case 70 and wound over the ribbon take-up spool 45.

The print head 60 and the head holder 69 of the first cassette receiving portion 21 are inserted in the head opening 71 upon attachment of the first cassette 7 to the first cassette receiving portion 21. The tape 5 and the ink ribbon 8 drawn out through the tape discharge opening 73 move frontward along a left side of the head opening 71.

Next, the second cassette 17 will be described with reference to FIG. 3. In the following description, a structure of the second cassette 17 will be described based on a posture of the second cassette 17 that is attached to the second cassette receiving portion 22. Incidentally, a cross-sectional plane for illustrating FIG. 3 is at the same height as a cross-sectional plane for illustrating FIG. 2 for better understanding to the second cassette 17 in connection with the head holder 69.

The second cassette 17 includes a front part 17A and a rear part 17B. The front part 17A constitutes a front portion of the second cassette 17, and has a structure approximately the same as the structure of the first cassette 7. The position of the front part 17A of the second cassette 17 attached to the second cassette receiving portion 22 is approximately the same as the position of the first cassette 7 attached to the first cassette receiving portion 21.

The front part 17A includes a case front part 170A, and the rear part 17B includes a case rear part 170B integral with the case front part 170A. The case front part 170A is formed with support holes 377 and 378, a tape discharge opening 373 and a head opening 371. The support hole 377 and the support hole 378 extend through a thickness of the case front part 170A in the upward/downward direction. The support hole 377 has a structure the same as that of the support hole 77 of the first cassette 7. The support hole 378 has a structure the same as that of the support hole 78 of the first cassette 7.

A ribbon spool 343 and a ribbon take-up spool 345 are positioned inside the case front part 170A. The support hole 377 rotatably supports the ribbon spool 343. The ink ribbon 8 for use in printing is wound over the ribbon spool 343. The ink ribbon 8 wound over the ribbon spool 343 has a length greater than that of the ink ribbon 8 wound over the ribbon spool 43 of the first cassette 7. Hence, prior to use of the second cassette 17 and first cassette 7, the ink ribbon 8 wound over the ribbon spool 343 has a larger diameter than the ink ribbon 8 wound over the ribbon spool 43 of the first cassette 7. The support hole 378 rotatably supports the ribbon take-up spool 345. The ribbon take-up shaft 62 of the cassette receiving portion 6 (second cassette receiving portion 22) is inserted in the ribbon take-up spool 345 when the second cassette 17 is attached to the second cassette receiving portion 22. The ink ribbon 8 used for printing is taken up by the ribbon take-up spool 345 and wound over the ribbon take-up spool 345.

The tape discharge opening 373 and the head opening 371 are shaped to be identical to the shapes of the tape discharge opening 73 and the head opening 71, respectively. Further, the ink ribbon 8 ejected from the tape discharge opening 373 is to be conveyed along a conveying passage that is identical to a conveying passage along which the ink ribbon 8 ejected from the tape discharge opening 73 is conveyed thereafter.

The rear part 17B constitutes a rear portion of the second cassette 17. The rear part 17B protrudes rearward through the second open end 32 and rightward through the third open end 33. The case rear part 170B has a rear end portion (protruding out through the second open end 32) that does not make contact with the movable cover 55 which is at the open position. The rear end portion of the case rear part 170B is semicircular shaped in a plan view. Here, the semicircular shape is concentric with the arcuate shape of the curved portion 58B of the movable cover 55 which is at the open position. The semicircular rear end portion is in confrontation with the curved portion 58B with a gap therebetween when the movable cover 55 is at the open position.

The case rear part 170B is formed with a support hole 399, and a first tape spool 341 is positioned inside the case rear part 170B. The support hole 399 extends throughout the case rear part 170B in the upward/downward direction. The support hole 399 rotatably supports the first tape spool 341. A length of the tape 5 wound over the first tape spool 341 is greater than a length of the tape 5 wound over the first tape spool 41 of the first cassette 7. Hence, prior to use of the first cassette 7 and second cassette 17, the tape 5 wound over the first tape spool 341 has a larger diameter than the tape 5 wound over the first tape spool 41 of the first cassette 7.

The tape 5 paid out from the first tape spool 341 is ejected through the tape discharge opening 373. The tape 5 ejected through the tape discharge opening 373 is then to be conveyed along a conveying passage that is identical to a conveying passage along which the tape 5 ejected from the tape discharge opening 73 of the first cassette 7 is to be conveyed. Incidentally, the first tape spool 341 defines a central axis C3 that is approximately at the same left-right position as the central axis C2 of the first tape spool 41 of the first cassette 7. In other words, the print head 60 is positioned offset from the central axis C3 toward the left.

Next, a printing process performed in the printing device 1 and using the first cassette 7 will be described with reference to FIGS. 2 and 4 through 6. Here, prior to attachment of the first cassette 7 to the first cassette receiving portion 21, the housing cover 51 is at the open position, the movable cover 55 is at the closed position (see FIG. 4), and the movable blade 140 is at the remote position.

For performing a printing operation with the first cassette 7, firstly, a user attaches the first cassette 7 to the first cassette receiving portion 21. More specifically, the first cassette 7 is placed above the first cassette receiving portion 21, and is moved downward. The first cassette 7 is thus entered into the interior of the housing 2 through the first open end 31. The guide portion 58A of the movable cover 55 restricts the first cassette 7 from moving rearward, while guiding the first cassette 7 to move downward. The ribbon take-up shaft 62 is inserted into the ribbon take-up spool 45; the head holder 69 and the print head 60 are inserted in the head opening 71; and the upper surface 16 comes into contact with the first cassette 7 from below. The first cassette 7 is thus attached to the first cassette receiving portion 21, as illustrated in FIG. 5.

Then, the housing cover 51 is pivotally moved from the open position (FIG. 5) to the closed position (FIG. 6). When the housing cover 51 reaches the closed position, the platen roller 65 comes to a position adjacent to the print head 60 and approaches the print head 60 from a left side thereof. The platen roller 65 presses, toward the print head 60, the tape 5 and the ink ribbon 8 in superposed relation those ejected through the tape discharge opening 73. The tape 5 and the ink ribbon 8 are nipped between the platen roller 65 and the print head 60.

Upon user's operation to the input portion, the conveyer motor and the discharge motor 299 are rotationally driven by the CPU to heat the heat generating elements of the print head 60. By the rotation of the conveyer motor, the platen roller 65 and the ribbon take-up shaft 62 respectively rotate in the clockwise direction in a plan view. By the rotation of the discharge motor 299, the discharge roller 220 rotates in the clockwise direction, and the opposing roller 230 rotates in a counterclockwise direction in a plan view.

By the rotation of the platen roller 65 and the ribbon take-up shaft 62, the tape 5 and the ink ribbon 8 nipped between the platen roller 65 and the print head 60 are both conveyed frontward. Ink of the ink ribbon 8 is thermally transferred onto the tape 5 through the heat applied to the ink ribbon 8 by the print head 60. In this way, the print head 60 can print character(s) on the tape 5.

The used ink ribbon 8 is wound over the ribbon take-up spool 45 by the rotation of the ribbon take-up shaft 62. The tape 5 printed by the print head 60 is conveyed into a position between the discharge roller 220 and the opposing roller 230. The tape 5 is conveyed frontward by the discharge roller 220 and the opposing roller 230, and a leading end portion of the tape 5 is ejected frontward through the discharge opening 11. The rotation of the conveyer motor and the discharge motor 299, and heat generation at the print head 60 are both stopped by the CPU.

Then, the cutter motor 105 is driven by the CPU to move the movable blade 140 from the remote position to the full-cutting position. The tape 5 is fully cut by the movable blade 140 and the fixed blade 179, and finally the cut tape 5 exposed through the discharge opening 11 is taken out by the user.

Incidentally, the first cassette 7 may be attached to the first cassette receiving portion 21 while the movable cover 55 is at the open position, rather than while the movable cover 55 is at its closed position. If the first cassette 7 is attached while the movable cover 55 is in its open position, the movable cover 55 may be moved to its closed position after the first cassette 7 is seated on the opposing surface 16.

Next, a printing process performed in the printing device 1 and using the second cassette 17 will be described with reference to FIGS. 1 through 3, 7, and 8. Here, prior to attachment of the second cassette 17 to the second cassette receiving portion 22, the housing cover 51 is at the open position, the movable cover 55 is at the open position (see FIG. 1), and the movable blade 140 is at the remote position.

For performing a printing operation with the second cassette 17, the second cassette 17 is first attached to the second cassette receiving portion 22. More specifically, the second cassette 17 is placed above the second cassette receiving portion 22, and is moved downward. The second cassette 17 is entered into the interior of the housing 2 through the first open end 31. The ribbon take-up shaft 62 is inserted into the ribbon take-up spool 345; the head holder 69 and the print head 60 are inserted in the head opening 371; and the upper surface 16 comes into contact with the second cassette 17 from below. The second cassette 17 is thus attached to the second cassette receiving portion 22, as illustrated in FIG. 7.

Then, the housing cover 51 is pivotally moved from the open position (FIG. 1) to the closed position (FIG. 8). When the housing cover 51 is at the closed position, the platen roller 65 comes to a position adjacent to the print head 60 and approaches the print head 60 from the left side thereof. The platen roller 65 presses, toward the print head 60, the tape 5 and the ink ribbon 8 in superposed relation and those ejected through the tape discharge opening 373.

The conveyer motor and the discharge motor 299 are rotationally driven by the CPU to heat the heat generating elements of the print head 60. The tape 5 is paid out from the first tape spool 341, and the ink ribbon 8 is paid out from the ribbon spool 343. Ink of the ink ribbon 8 is thermally transferred to the tape 5 by the heat applied from the print head 60. A used part of the ink ribbon 8 is wound over the ribbon take-up spool 345 by the rotation of the ribbon take-up shaft 62.

Ejection of the printed tape 5 through the tape discharge opening 373 and full cutting operation by the cutter unit 100 to the printed tape 5 are the same as those performed with respect to the first cassette 7 attached to the first cassette receiving portion 21, and therefore, further description will be omitted. Further, the cut tape 5 is then to be ejected through the discharge opening 11 by the discharge unit 200 as in the same manner as that performed to the first cassette 7 attached to the first cassette receiving portion 21, and therefore, further description will be omitted.

As described above, for attachment of the second cassette 17 including the ink ribbon 8 and tape 5, the second cassette 17 is moved downward in the upward/downward direction to be attached to the second cassette receiving portion 22 through the first open end 31. Upon attachment of the second cassette 17, the print head 60 is inserted in the head opening 371 of the second cassette 17. In the state where the second cassette 17 is attached to the second cassette receiving portion 22, the rear part 17B of the second cassette receiving portion 22 protrudes rearward through the second open end 32. That is, the printing device 1 can accommodate the second cassette 17 (incorporating the ink ribbon 8 and tape 5) in the second cassette receiving portion 22 with a portion of the second cassette 17 protruding out from the housing 2. This structure can realize downsizing of the housing 2 of the printing device 1 in a state where the second cassette 17 is not attached to the second cassette receiving portion 22. Transportation and packaging of the printing device 1 without the second cassette 17 can be thus facilitated.

The second open end 32 is open rearward, which is a direction opposite to a direction in which the tape 5 is to be discharged through the discharge opening 11. Hence, the rear part 17B of the second cassette 17 is exposed rearward through the second open end 32 at a position far away from the discharge opening 11. Attachment of the second cassette 17 to the second cassette receiving portion 22 is thus facilitated.

The second open end 32 is open rearward, which is a direction opposite to a conveying direction of the tape 5 between the print head 60 and the platen roller 65. In other words, the second open end 32 is open toward upstream in the conveying direction of the tape 5 between the print head 60 and the platen roller 65. The rear part 17B of the second cassette 17 attached to the second cassette receiving portion 22 protrudes rearward through the second open end 32 at a position remote from the print head 60 and the platen roller 65. This structure can further facilitate attachment of the second cassette 17 to the second cassette receiving portion 22.

Further, the second cassette receiving portion 22 has the third open end 33 that is open rightward. That is, the cassette receiving portion 6 is open rightward. This third open end 33 allows the rear part 17B of the second cassette 17 to protrude rightward therethrough, when the second cassette 17 is attached to the second cassette receiving portion 22. With this structure, the second cassette 17 is less likely to interfere with the housing 2 during attachment of the second cassette 17 to the second cassette receiving portion 22. Attachment of the second cassette 17 to the second cassette receiving portion 22 (the cassette receiving portion 6) is further facilitated.

Further, the printing device 1 of the present embodiment includes the movable cover 55 capable of covering and uncovering the second open end 32 and the third open end 33. At the closed position, the movable cover 55 closes both of the second open end 32 and third open end 33. This structure can minimize exposure of the cassette receiving portion 6 to the outside of the housing 2, thereby suppressing entry of foreign matters, such as dusts, into the cassette receiving portion 6.

The opposing surface 16 of the housing 2 is adapted to face and contact the second cassette 17 from below upon attachment of the second cassette 17 to the second cassette receiving portion 22. With this structure, the second cassette 17 attached to the second cassette receiving portion 22 can be stably held therein with little wobbling.

Various modifications are conceivable.

For example, the cassette receiving portion 6 may not be able to accommodate selected one of the first cassette 7 and the second cassette 17. That is, the cassette receiving portion 6 may be able to receive only one type of cassette, rather than a plurality of types of cassettes. Further, the cassette receiving portion 6 may not have the third open end 33. If this is the case, the rear part 17B of the second cassette 17 attached to the second cassette receiving portion 22 does NOT protrude rightward from the housing 2.

Further, the discharge opening 11 may be formed in the left side part 2B of the housing 2, instead of the front side part 2C, such that the discharge opening 11 can be open leftward. That is, the direction in which the second open end 32 opens (i.e., rearward direction) is orthogonal to the direction in which the discharge opening 11 opens (i.e., rightward direction).

Further, the second open end 32 may be opened rightward, for example, rather than rearward (i.e., upstream in the conveying direction of the tape 5 between the print head 60 and the platen roller 65). Likewise, the third open end 33 may be opened leftward, rather than rightward. In the latter case, the rear part 17B of the second cassette 17 attached to the second cassette receiving portion 22 may protrude leftward, rather than rightward, through the third open end 33.

Further, the movable cover 55 may not open and close the third open end 33 of the housing 2. More specifically, the third open end 33 may be always open rightward, regardless of the movement of the movable cover 55, so that the movable cover 55 covers and uncovers the second open end 32, only. Alternatively, the printing device 1 may not include the movable cover 55, so that the second open end 32 and the third open end 33 are both normally open.

Still further, the opposing surface 16 of the housing 2 may face the attached second cassette 17 from below with a gap therebetween. Even with this structure, the opposing surface 16 can restrain wobbling of the second cassette 17 attached to the second cassette receiving portion 22. Stable attachment of the second cassette 17 to the second cassette receiving portion 22 (the cassette receiving portion 6) can be thus realized.

While the description has been made in detail with reference to specific embodiment thereof, it would be apparent to those skilled in the art that various changes and modifications may be made therein without departing from the scope of the above described embodiment.

<Remarks >

The printing device 1 is an example of a printing device. The housing 2 is an example of a housing. The second cassette 17 is an example of a cassette. The cassette receiving portion 6 and second cassette receiving portion 22 are an example of a cassette receiving portion. The discharge opening 11 is an example of a discharge opening. The platen roller 65 is an example of a platen roller. The opposing surface 16 is an example of a bottom wall of the cassette receiving portion. The center C1 is an example of a center of the housing. The center C3 is an example of a center of a tape spool of the cassette. The movable cover 55 is an example of a movable cover. The housing cover 51 is an example of a housing cover. The upward direction is an example of a first direction. The rearward direction is an example of a second direction. The rightward direction is an example of a third direction. The leftward direction is an example of a fourth direction.

What is claimed is:

1. A printing device comprising:

a housing;

a cassette receiving portion provided in the housing and configured to detachably receive a cassette including a case in which an ink ribbon and a tape are provided, the case being formed with a head opening; and a print head provided at the cassette receiving portion and configured to perform printing to the tape via the ink ribbon, the print head extending in a first direction and being configured to be inserted in the head opening upon attachment of the cassette to the cassette receiving portion, wherein the cassette receiving portion is open in the first direction and in a second direction orthogonal to the first direction, wherein, upon attachment of the cassette to the cassette receiving portion, a portion of the cassette protrudes out of the housing in the second direction, and wherein the cassette receiving portion is further open in a third direction perpendicular to the first direction and the second direction.

2. The printing device according to claim 1, wherein the housing is formed with a discharge opening through which the tape printed by the print head is configured to be discharged, and wherein the second direction is opposite to a direction in which the tape is configured to be discharged through the discharge opening.

3. The printing device according to claim 1, further comprising a platen roller positioned to oppose the print head and configured to convey the tape printed by the print head, wherein the second direction is opposite to a direction in which the tape is configured to be conveyed between the print head and the platen roller.

4. The printing device according to claim 1, wherein the housing is formed with a discharge opening through which the tape printed by the print head is configured to be discharged, and wherein the discharge opening is positioned offset from a center of the housing in a fourth direction opposite to the third direction.

5. The printing device according to claim 1, wherein the print head is positioned offset from a center of the housing in a fourth direction opposite to the third direction.

6. The printing device according to claim 1, further comprising a platen roller configured to convey the tape printed by the print head, the platen roller being positioned to oppose the print head in a fourth direction opposite to the third direction.

7. The printing device according to claim 1, wherein the tape in the cassette is wound around a tape spool defining a center, and wherein the print head is positioned offset from the center of the tape spool of the cassette received in the cassette receiving portion.

8. The printing device according to claim 1, wherein the housing is formed with an insertion hole through which an external electrical wiring is insertable, the insertion hole being open in the second direction and being positioned offset from the print head in the third direction.

9. The printing device according to claim 1, wherein, upon attachment of the cassette to the cassette receiving portion, the portion of the cassette also protrudes out of the housing in the third direction.

10. The printing device according to claim 1, further comprising a movable cover configured to cover the cassette receiving portion in the second direction.

11. The printing device according to claim 1, wherein the cassette receiving portion comprises a bottom wall configured to face the cassette received in the cassette receiving portion in the first direction.

12. The printing device according to claim 1, further comprising a housing cover movably connected to the housing and configured to cover the cassette receiving portion in the first direction.

13. The printing device according to claim 1, further comprising:

a discharge unit disposed inside the housing and comprises a discharge roller configured to discharge the tape after printing is performed to the tape by the print head; and a cutter unit disposed inside the housing and comprises a cutter configured to cut the tape discharged by the discharge unit.

14. The printing device according to claim 1, wherein the first direction is an upward direction, and the second direction is a rearward direction.

15. A printing device comprising:

a housing;

a cassette receiving portion provided in the housing and configured to detachably receive a cassette including a case in which an ink ribbon and a tape are provided, the case being formed with a head opening; and a print head provided at the cassette receiving portion and configured to perform printing to the tape via the ink ribbon, the print head extending in a first direction and being configured to be inserted in the head opening upon attachment of the cassette to the cassette receiving portion, wherein the cassette receiving portion is open in the first direction and in a second direction orthogonal to the first direction, and wherein, upon attachment of the cassette to the cassette receiving portion, a portion of the cassette protrudes out of the cassette receiving portion and is exposed to an outside of the housing in the second direction.

16. The printing device according to claim 15, further comprising a platen roller positioned to oppose the print head and configured to convey the tape printed by the print head, wherein the portion of the cassette is exposed in the second direction in a state where the tape is conveyed between the print head and the platen roller.

17. The printing device according to claim 16, wherein the portion of the cassette is exposed in the second direction in a state where the ink ribbon is conveyed between the print head and the platen roller.

18. The printing device according to claim 16, further comprising a movable cover configured to cover the cassette receiving portion in the second direction, wherein the cover is configured to be opened outward relative to the housing to expose the cassette receiving portion in the second direction.

19. The printing device according to claim 18, wherein the cover has a part configured to face the cassette received in the cassette receiving portion in a state where the cover is opened relative to the housing in the second direction.

* * * * *